United States Patent [19]

Burke

[11] 4,326,485

[45] Apr. 27, 1982

[54] STARTING FLUID INJECTION APPARATUS

[76] Inventor: James W. Burke, Rte. 2, Box 476, Long Grove, Ill. 60047

[21] Appl. No.: 123,462

[22] Filed: Feb. 21, 1980

[51] Int. Cl.[3] ..... F02M 1/16

[52] U.S. Cl. ..... 123/180 AC; 123/187.5 R

[58] Field of Search ..... 123/180 AC, 180 R, 187.5 R, 123/187.5 P, 179 G, 1 A, 575

[56] References Cited

U.S. PATENT DOCUMENTS

| | | | |
|---|---|---|---|
| 2,553,079 | 5/1951 | Casteel | 123/187.5 R |
| 2,945,483 | 7/1960 | Howell | 123/180 R |
| 3,189,014 | 6/1965 | Kus | 123/187.5 R |
| 3,297,011 | 1/1967 | Gray | 123/180 R |
| 3,448,733 | 6/1969 | Aske | 123/180 R |
| 3,827,417 | 8/1974 | Morita | 123/180 R |
| 4,161,160 | 7/1979 | Hicks et al. | 123/180 R |
| 4,202,309 | 5/1980 | Burke | 123/180 AC |

FOREIGN PATENT DOCUMENTS

| | | | |
|---|---|---|---|
| 593822 | 2/1925 | France | 123/180 R |

*Primary Examiner*—P. S. Lall

*Attorney, Agent, or Firm*—Hume, Clement, Brinks, Willian & Olds, Ltd.

[57] ABSTRACT

An improved starting fluid injection apparatus for an internal combustion engine includes a valved container of starting fluid, a valve actuator, an injector assembly, and a conduit interconnecting the actuator and the injector assembly. According to a first feature of the invention, a flow metering orifice is provided in either the actuator, or the conduit at a point spaced from the injector assembly, or the injector assembly. This orifice relieves constraints related to fluid metering from the injector orifice, and permits the use of a greater number of larger injector orifices than would otherwise be possible. Multiple flow metering orifices can be used upstream of the injector orifices. Additionally, in some applications it is possible to dispense with injector orifices entirely.

21 Claims, 7 Drawing Figures

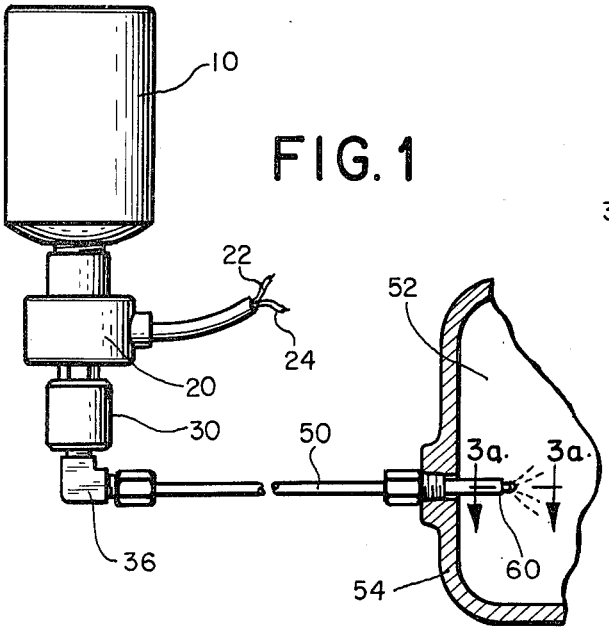
FIG. 1
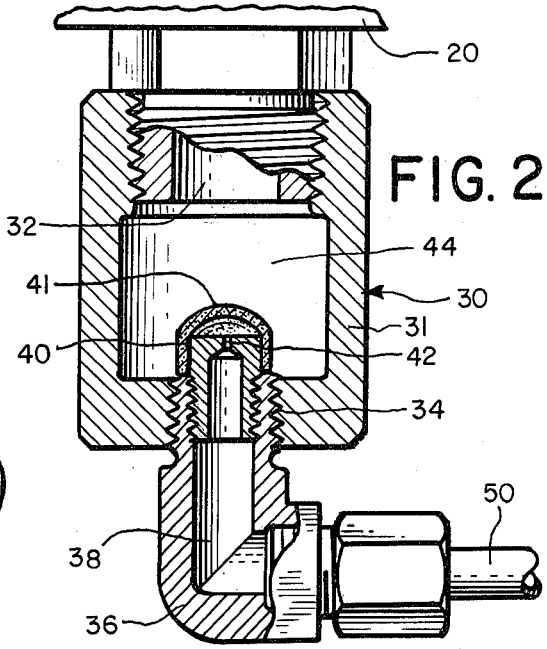
FIG. 2
FIG. 3a
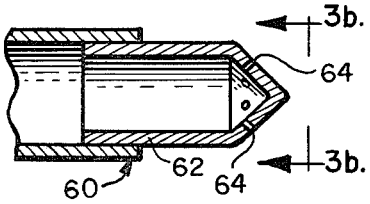
FIG. 3b
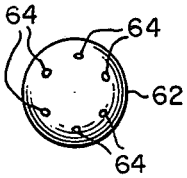
FIG. 4
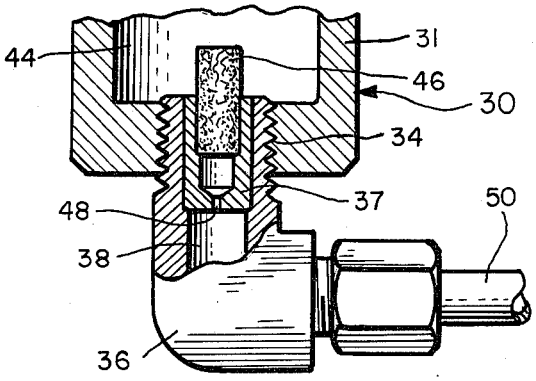
FIG. 5
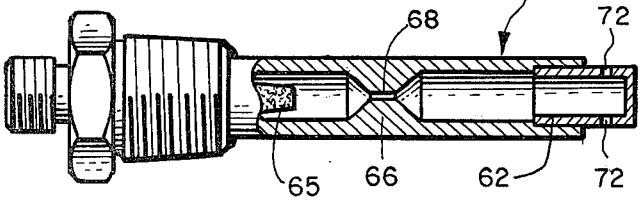
FIG. 6
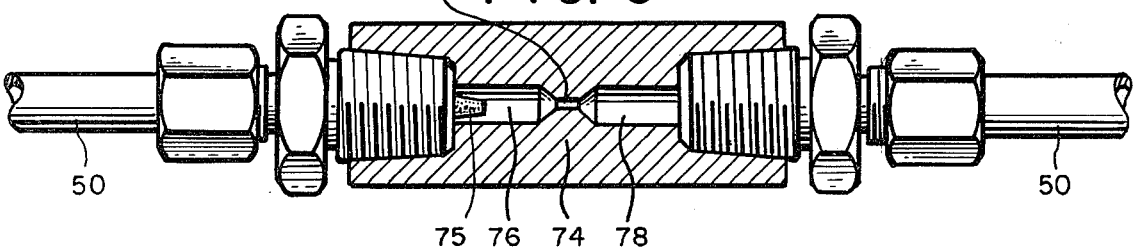

STARTING FLUID INJECTION APPARATUS

BACKGROUND OF THE INVENTION

The present invention relates to starting fluid injection systems for use with internal combustion engines.

Internal combustion engines, especially diesel engines, are notoriously difficult to start under low temperature conditions. As a consequence, various cold starting aids have come into widespread use. Among the most successful of these are starting fluid injection systems which inject a starting fluid, such as an ether based fuel, into the air intake passages of an engine during engine startup.

Commonly used starting fluid injection systems generally include an injector assembly having an injection orifice. Starting fluid is passed through this orifice into the engine. Since the orifice acts both (1) to restrict and meter the flow of starting fluid into the engine and (2) to form and direct the jet of starting fluid into the engine, certain compromises are inevitable. In order to obtain an orifice small enough to adequately limit the flow of starting fluid, it may be necessary to use only one or a small number of very small orifices. Small orifices are difficult to manufacture and furthermore, are subject to clogging due to foreign matter at the injector and ice formations. Furthermore, when only a few orifices are used, it may not be possible to achieve optimum distribution of starting fluid within the engine.

SUMMARY OF THE INVENTION

The present invention is directed to an improved starting fluid injection system which operates to improve the metering and injection of starting fluid and to reduce the recurring operational problem of clogged orifices.

According to one feature of this invention a starting fluid injection system is provided with at least two orifices connected in series. The first orifice acts primarily as a flow metering orifice to regulate the flow of starting fluid to the injector assembly. The other orifice acts primarily as an injection orifice to distribute the starting fluid within the engine. Because two orifices are used in series, neither need be as small as in the case of a single orifice to provide the desired metering effect. It is often preferable to size the injection orifice larger than the flow metering orifice, for it is the injection orifice which is generally more subject to clogging from external contaminants. In various embodiments of this feature of the invention, the flow metering orifice can advantageously be placed at several points in the injection system between the starting fluid container and the injection orifice. By separating, to a degree, the functions of starting fluid metering and starting fluid distribution, this feature of the invention allows such function of the injection system to be optimized individually.

According to a second feature of the invention a starting fluid injection system is provided with a flow metering orifice at a point spaced from the injector such that starting fluid, which has been cooled by expansion effects following passage through the orifice, is resident in the injection system for a period of time and is warmed prior to reaching the injector, thereby increasing the volatility of the starting fluid at the time it is injected into the engine. This feature of the invention can be used with a wide range of injector assemblies, including injector assemblies which include substantially no flow restriction orifices. The warming effect and increased residence times associated with this feature of the invention improve the atomization of the starting fluid, and consequently the distribution of the injected starting fluid within the engine.

According to a third feature of the invention, a starting fluid injection system is provided with a plurality of flow metering orifices connected in series to meter and regulate the flow of starting fluid to the injector. When multiple orifices are used in series, a given flow rate can be achieved with larger area orifices, thereby eliminating the need for extremely small orifices. This brings significant advantages, for extremely small orifices can be difficult to manufacture and they are prone to clogging during use due to foreign matter and ice formations.

A preferred embodiment of the invention includes a flow metering orifice as a part in the valve actuator of the injection system. This can be an important safety advantage, for it substantially reduces the danger that a valve actuator will be paired with an overly large orifice in a given application. In the past, it was the injector assembly which commonly provided the flow limiting orifice. Furthermore, injector assemblies, and consequently the flow limiting orifices, are often changed in the field during routine service. If an excessively large orifice injector assembly were used, engine damage could result. In contrast, when the flow limiting orifice is included in the valve actuator, injector assemblies can be freely changed without concern for engine damage due to improperly sized injector orifices.

The invention, together with further objects and attendant advantages, will best be understood by reference to the following detailed description taken in connection with the appended drawings.

BRIEF DESCRIPTION OF THE DRAWINGS

FIG. 1 is a schematic representation of a preferred embodiment of the present invention.

FIG. 2 is a cross-sectional view of a portion of the structure of FIG. 1.

FIG. 3*a* is a cross-sectional view taken along line 3*a*—3*a* of FIG. 1.

FIG. 3*b* is an end view taken along line 3*b*—3*b* of FIG. 3*a*.

FIG. 4 is a cross-sectional view of an alternate embodiment of the structure of FIG. 2.

FIG. 5 is a cross-sectional view of an alternate embodiment of the injector of FIG. 1.

FIG. 6 is a cross-sectional view of a flow metering orifice for use in the conduit 50 of FIG. 1.

DETAILED DESCRIPTION OF PREFERRED EMBODIMENTS

Referring now to the drawings, FIG. 1 depicts schematically a first preferred embodiment of the present invention. This embodiment includes a cannister 10 which contains a pressurized starting fluid. In this preferred embodiment, starting fluid is an ether-based hydrocarbon fuel; however, other starting fluids may be advantageously used in connection with this invention as well. The cannister 10 is mounted to a valve actuator 20 which controls the flow of starting fluid out of the cannister 10. In this preferred embodiment, the actuator 20 includes an electrical solenoid powered by electrical current passed through conductors 22,24. When a voltage is supplied across the two conductors 22 and 24, the electrically powered solenoid operates a valve to permit starting fluid to pass out of the cannister 10 into the reservoir 30. This reservoir 30, which will be described in detail in connection with FIGS. 2 and 4, is in fluid communication with a conduit 50. The conduit 50 terminates in an injector assembly 60 which is mounted in an air intake manifold 54 of an internal combustion engine (not shown). When the actuator 20 is energized, starting fluid passes out of the cannister 10 into the reservoir 30 and then on, via the conduit 50, to the injector assembly 60, where it sprays into the air intake passages 52 of the internal combustion engine.

Referring now to FIG. 2, the reservoir 30 is there shown in greater detail. This reservoir 30 includes a cylindrical sleeve 31 which is coupled to the conduit 50 by a fitting 36. The interior of the sleeve 30 defines a cavity 44. This cavity serves to receive starting fluid from the cannistor 10 and to hold a position of the starting fluid until after the actuator 20 has stopped the flow of starting fluid out of the cannister 10. At this point, starting fluid trapped temporarily in the cavity 44 passes out of the cavity via the conduit 50 to the injector assembly 60, thereby providing a sustained flow of starting fluid for a period immediately following termination of flow out of the cannister 10.

As shown in FIG. 2, the fitting 36 includes an internal passageway 38 that extends from the cavity 44 at one end to the conduit 50 at the other end. This passageway 38 is provided with a threaded plug 40 at the end adjacent the cavity 44. This threaded plug 40 fits snugly within the passageway 38 and contains a flow metering orifice 42 which meters the flow of starting fluid out of the cavity 44 into the passageway 38. For clarity of illustration the size of the orifice 42 as well as all other orifices shown in the Figures have been exaggerated. A sintered bronze filter 41 is placed over the plug 40 to reduce clogging of the orifice 42.

One important advantage of the orifice 42 is that it insures that the reservior 44 fills with fluid when the actuator 20 releases starting fluid from the cannister 10. In the absence of the plug 40 there is a tendency for the starting fluid to jet directly out of the actuator 20 through the entrance bore 32 of the reservoir, and directly out the exit bore 34 of the reservoir, without substantially filling the cavity 44. The threaded plug 40 prevents such direct passage of starting fluid out of the cavity 44 and the flow metering orifice 42 insures that sufficient starting fluid builds up to cause the starting fluid to substantially fill the cavity 44.

The injector assembly 60 includes an end portion which is shown in detail in FIG. 3*a*. This end portion 62 terminates in a roughly conical point. This conical point is perforated by six separate injection orifices 64 through which starting fluid is sprayed out into the air intake passage 52. In this way the distribution of the starting fluid within the air intake passage 52 is optimized. Furthermore, by using large orifices, the atomization of the starting fluid is also improved. Throughout this specification and the following claims, the term "injector assembly" will be used to refer to the entire structure which is mounted in the engine and coupled to the conduit, while the term "injector" will be reserved for the portion of the injector assembly adjacent the opening or openings through which starting fluid passes into the engine.

One important feature of the embodiment of FIG. 1 is that it provides a plurality of flow metering orifices which operate in series to restrict the flow of starting fluid out of the cannister 10 into the air intake passage 52. This is advantageous because it permits the separation of two different functions which have in the past been accomplished by a single flow-metering orifice. The first of these functions is flow metering. In this preferred embodiment, it is the flow metering orifice 42 in the threaded plug 40 which provides most of the metering effect. That is, the pressure drop across the orifice 42 is greater than the pressure drop across the injector assembly 60. The second function is to direct and disperse the starting fluid as it leaves the injector assembly 60 and enters the air intake passage 52. In this preferred embodiment, this function of directing the stream of starting fluid is accomplished by the orifices 64. Since the metering function has, to a large extent, been separated from the distribution function, it is now possible to design the end section 62 of the injector assembly 60 to provide the optimum distribution pattern, without concern for whether the resulting pattern also optimizes flow rate. More specifically, the use of two or more sets of orifices 42,64 in series permits the use of much larger orifices 64 in much greater numbers than would otherwise be possible. Here, it is to be understood that a set of orifices can be made up of a single orifice.

When starting fluid is injected into a small engine, it has been conventional in the past to use small injection orifices in the injector assembly 60. Otherwise, the flow rate of starting fluid into the engine can be excessive, a condition which can lead to engine damage and wasted starting fluid. Thus, in the past it was not always possible to use the optimum number of injector orifices to provide optimum dispersion of the starting fluid. Furthermore, as a practical matter, the minimum size of injector orifices is limited by manufacturing difficulties and by the tendency of extremely small orifices to clog in use. These practical difficulties further restricted the size and number of injection orifices that could be used consonant with proper flow metering of the starting fluid.

The embodiment in FIG. 1 separates the metering function from the starting fluid distribution function to a degree, thereby allowing each of these two functions to be optimized individually. Thus the size, or number, of the orifice 42 can be chosen to provide the desired flow rate while the size and number of the orifices 64 can be chosen to provide optimum distribution and atomization for the starting fluid as it passes out of the injector assembly 60 into the air intake passage 52.

Another advantage of this embodiment of the invention is that it provides improved atomization of starting fluid. As the pressurized starting fluid passes through the flow metering orifice 42, it expands rapidly. As it expands, the starting fluid cools sharply, thereby reducing the volatility of the starting fluid in the region of the fitting 36. However, as the starting fluid travels through the conduit 50 to the injector assembly 60, it is warmed somewhat by the conduit 50. Thus, starting fluid which emerges from the orifices 64 in the injector assembly 60 is warmer because of the operation of the flow metering orifice 42. This warming effect improves the vaporization and atomization of starting fluid as it travels to and through the injector assembly 60, thereby improving the startup characteristics of the engine. The mechanism of this feature of the invention is not completely understood at present, and it may be that the relatively long residence time of the low pressure starting fluid in the conduit 50 is also an important factor in achieving proper atomization of the starting fluid.

This feature of the invention has been tested in the following experimental arrangement: A Cummins NTC-400 six cylinder diesel engine was equipped with a single injector assembly in the air intake manifold above the intercooler. This injector assembly was coupled to a reservoir of the type shown in FIG. 4 by about three feet of plastic conduit having an inner diameter of about one-sixteenth of an inch. The metering orifice in the reservoir 30 had a diameter of 0.010 inches, the reservior 30 had a volume of seven cubic centimeters, and the actuator had an internal volume of about one cubic centimeter. In these tests it was found that good engine starting characteristics can be obtained at temperatures down to at least −10° F. without any type of restricting orifice in the injector assembly at all. In this embodiment the conduit terminates at the air intake passage 52 without any restriction at all; the conduit is merely held in place in the manifold 54 by a fitting. The metering orifice serves to regulate the flow rate of the starting fluid out of the cavity 44, and the warming effect of the conduit 50 ensures that the starting fluid is adequately atomized as it enters the intake passage 52.

Turning now to FIG. 4, an alternate embodiment of the reservoir 30 and fitting 36 of FIG. 2 is there shown. The embodiment of FIG. 4 includes a cylindrical sleeve 31, having an entrance bore 32 and an exit bore 34 which define an internal cavity 44 exactly as in FIG. 2. In this case, however, the fitting 36 is provided with an internal sleeve 37 which fits within the passageway 38 in the fitting 36. This sleeve 37 defines a flow metering orifice 48, which serves the function of the flow metering orifices 42 in the embodiment of FIG. 2. In addition, a filter 46 is placed inside the sleeve 37 to protect the orifice 48 against clogging. Preferably, this filter is a sintered bronze filter, having a filter grade of 46 or 150, depending on the size of the orifice. The embodiment of FIG. 4 functions in the same manner as the embodiment of FIG. 2, providing the same advantages of improved atomization.

FIG. 5 presents an alternate embodiment in which an additional metering orifice is included in the injector assembly 60'. As shown in FIG. 5, the injector assembly 60' includes an intermediate section 66 in which is formed a flow metering orifice 68. A sintered bronze filter 65 is placed between the conduit 50 and the orifice 68. In general terms, this flow metering orifice 68 corresponds to the orifice 48 of FIG. 4. The end section 62 of the injector assembly 60 is secured to one end of the intermediate section 66. This end section 62 defines two injection orifices 72 which direct the flow of starting fluid out of the injector 60 into the air intake passage 52. The embodiment of FIG. 5 substantially separates the functions of flow metering and flow distribution, and therefore provides this advantage, as do the earlier embodiments. However, because the injection orifice 68 is directly adjacent the flow metering orifices 72, the warming effect previously discussed in connection with the embodiment of FIG. 2 is less pronounced here.

FIG. 6 shows yet another possible embodiment of this invention, in which a flow metering orifice 80, defined in a tubular sleeve 74, is placed in the length of the conduit 50. In this preferred embodiment, the sleeve 74 defines an entrance bore 76 and an exit bore 78, and the orifice 80 is situated therebetween. A sintered bronze filter 75 is placed in the entrance bore 76. The sleeve 74 can be placed anywhere along the length of the conduit 50 and, depending upon its proximity to the nozzle 60, it may provide the advantage of allowing starting fluid to warm prior to its injection out of the injector assembly 60. The embodiment of FIG. 6 can be used with the embodiments of FIGS. 2, 4, or 5 where it is desired to use multiple metering orifices in series to avoid extremely small orifices. In this way, three or more orifices can easily be placed in series.

The present invention can be used in a wide variety of internal combustion engines, using a wide variety of starting fluids. For purposes of illustration, a preferred embodiment will be described in detail. This preferred embodiment is suitable for use with the Cummins 6-cylinder in-line diesel engine, Model NTC-400. This engine has a displacement of 855 cubic inches and has a rated horesepower of 400. In this preferred embodiment, a reservoir of the type shown in FIG. 4 is used. This reservoir has an internal volume of about seven cubic centimeters, the actuator 20 has an internal reservoir volume of about one cubic centimeter, and therefore the total reservoir volume is about eight cubic centimeters. The actuator 20 is of the type described in detail in my copending U.S. Patent Application Ser. No. 926,413, filed July 20, 1978, now U.S. Pat. No. 4,202,309, which is hereby incorporated by reference. The flow metering orifice 48 preferably has a diameter of ten-thousandths of an inch, and three separate injector assemblies 60 are used. Each of these three injector assemblies 60 is placed on the underside of the intake manifold of the engine near one of the three sets of intake ports. Each injector assembly 60 includes one orifice 64 directed at the adjacent intake ports, each orifice 64 having a diameter of thirteen-thousandths of an inch. It has been found that, by using multiple injector assemblies 60 placed adjacent the intake ports, engine starting is dramatically improved at extremely cold temperatures. In addition, the amount of starting fluid required to consistently start an engine is reduced when the multiple injector orifice or the multiple injector assembly features of this invention are employed.

Another significant advantage of this invention is that the safety of the overall injection system is improved when the metering orifice is directly associated with the actuator 20. This is because in the field it is not uncommon for an actuator 20 designed for a particular application to be used with the various injector assemblies 60. Thus, depending on how carefully the injector assembly 60 is chosen to match the engine's characteristics, the metering of starting fluid can be either adequate, or inadequate, or so excessive as actually to be unsafe. When, on the other hand, the metering orifice is actually placed in or adjacent the actuator 20, there is a reduced chance that a metering orifice of improper dimensions will be substituted during routine maintenance and servicing.

As previously mentioned, yet another advantage of the invention is that it allows the use of larger orifices on the injector assembly as well as the use of more orifices on the injector assembly, as well as the use of more injector assemblies. The advantages of larger orifices on the injector assembly is that they are easier to manufacture and less subject to clogging in use. An important advantages of multiple injector orifices and multiple injector assemblies is that the distribution and atomization of starting fluid within the air intake passages is improved. In addition, in several embodiments flow metering orifices have been moved out of the injector assembly to other locations where they are more easily provided with large area filters and are more easily accessible for field service.

The present invention has been described in connection with an actuator 20 having a reservoir 30. My above referenced co-pending application, Ser. No. 926,413 (now U.S. Pat. No. 4,202,309) describes in detail the function and operation of such an injection system. However, it is to be understood that the present invention can be used with other types of actuators. For example, the invention can be used both with measured shot actuators and with continuous flow actuators, whether electrically or mechanically operated. In addition, the invention can be used in injection systems in which the cannister is situated below the actuator. These and other changes and modifications to the preferred embodiments described herein will be apparent to those skilled in the art. For example, other mechanical structures can be used to define the metering orifices, and the metering orifices can be placed in other points in the injection system. Such changes and modifications fall within the spirit and scope of the present invention, and it is therefore intended that all such changes and modifications be covered by the following claims.

I claim:

1. In a starting fluid injection apparatus for an internal combustion engine, said apparatus including an actuator for selectively releasing a starting fluid from a container, injector means for injecting starting fluid into an air intake passage of the engine, and a conduit for interconnecting the actuator and the injector means, the improvement comprising:

flow metering orifice means, included in the injection apparatus, for metering the flow rate of starting fluid from the actuator to the injector means; and an injection orifice included in the injector means in series with the flow metering orifice means such that starting fluid passes through the orifice means and then through the injection orifice as it passes from the container, through the conduit, and out the injector means, wherein the flow metering orifice means is sized such that the pressure drop across the injection orifice is substantially no greater than the pressure drop across the flow metering orifice means during injection of starting fluid into the engine.

2. The invention in claim 1 further including at least one additional injection orifice included in the injector means in series with the flow metering orifice means and in parallel with the injection orifice such that said at least one additional injection orifice is in fluid communication with said injection orifice.

3. The invention of claim 1 wherein the flow metering orifice means is included in the actuator.

4. The invention of claim 1 wherein the flow metering orifice means is included in the conduit.

5. The invention of claim 1 wherein the flow metering orifice means is included in an injector assembly situated adjacent the injector means.

6. The invention of claim 1 wherein the injection apparatus includes a reservior in fluid communication with the conduit to temporarily store starting fluid immediately following deactivation of the actuator, said reservoir having an entrance port and an exit port, and further wherein the flow metering orifice means is positioned near the exit port of the reservoir.

7. The invention of claim 1 wherein the flow metering orifice means restricts the flow rate of starting fluid into the engine to a safe rate.

8. The invention of claim 1 or 2 or 3 or 4 or 5 or 6 wherein the flow metering orifice means comprises a metering orifice having a diameter of less than about 0.01 inches.

9. In a starting fluid injection apparatus for an internal combustion engine, said apparatus including an actuator for selectively releasing a starting fluid from a container, injector means for injecting starting fluid into an air intake passage of the engine, and a conduit for interconnecting the actuator and the injector means, the improvement comprising:

a flow metering orifice included in the actuator and spaced from the injector means such that starting fluid, which has been cooled by expansion effects following passage through the flow metering orifice, is warmed by the conduit prior to reaching the injector means, thereby increasing the volatility of the starting fluid, said flow metering orifice being sized such that the pressure drop across the injector means during the flow of starting fluid from the container to the engine is substantially no greater than the pressure drop across the flow metering orifice.

10. The invention of claim 9 wherein the injector means includes a fluid passageway in fluid communication with the conduit and the minimum cross-sectional area of the passageway is substantially no smaller than the cross-sectional area of the conduit.

11. The invention of claim 9 or 10 wherein the diameter of the flow metering orifice is less than about 0.01 inches.

12. In a starting fluid injection apparatus for an internal combustion engine, said apparatus including an actuator for selectively releasing a starting fluid from a container, injector means for injecting starting fluid into an air intake passage of the engine, and a conduit for interconnecting the actuator and the injector means, the improvement comprising:

a flow metering orifice included in the conduit and spaced from the injector means such that starting fluid, which has been cooled by expansion effects following passage through the flow metering orifice, is warmed by the conduit prior to reaching the injector means, thereby increasing the volatility of the starting fluid, said flow metering orifice being sized such that the pressure drop across the injector means during the flow of starting fluid from the container to the engine is substantially no greater than the pressure drop across the flow metering orifice.

13. The invention of claim 12 wherein the injector means includes a fluid passageway in fluid communication with the conduit and the minimum cross-sectional area of the passageway is substantially no smaller than the cross-sectional area of the conduit.

14. The invention of claim 12 or 13 wherein the diameter of the flow metering orifice is less than about 0.01 inches.

15. In a starting fluid injection apparatus for an internal combustion engine, said apparatus comprising a reservoir having an entrance port and an exit port, injector means for injecting starting fluid into an air intake passage of the engine, a conduit interconnected between the exit port and the injector means, and an actuator for selectively releasing a pressurized starting fluid out of a cannister into the reservoir via the entrance port, the improvement comprising:

a flow metering orifice situated near the exit port of the reservoir; and at least one injection orifice included in the injector means, said injector orifice having a larger cross-sectional area than the flow metering orifice such that, when the actuator is releasing starting fluid out of the cannister, the pressure drop across the flow metering orifice is greater than the pressure drop across the injection orifice.

16. The invention of claim 15 wherein the diameter of the flow metering orifice is less than about 0.01 inches.

17. In a starting fluid injection apparatus for an internal combustion engine, said apparatus including an actuator for selectively releasing a starting fluid from a container, injector means for injecting starting fluid into an air intake passage of the engine, and a conduit for interconnecting the actuator and the injector means, the improvement comprising:

a flow metering orifice included in the injection apparatus to meter the flow rate of starting fluid from the container to the injector; and at least one injection orifice included in the injector means, said injection orifice in fluid communication with the conduit such that starting fluid passes through the conduit out of the injector means via the injection orifice, said injection orifice operating in series with the flow metering orifice such that starting fluid passes through both the flow metering orifice and the injection orifice during operation of the injection apparatus and the pressure drop across the injection orifice is substantially no greater than the pressure drop across the flow metering orifice during injection of starting fluid into the engine.

18. The invention of claim 17 wherein the diameter of the flow metering orifice is less than about 0.01 inches.

19. The invention of claim 17 wherein said at least one injection orifice includes two injection orifices.

20. The invention of claim 17 wherein said at least one injection orifice includes six injection orifices.

21. The invention of claim 9 or 12 or 17 or 15 wherein the flow metering orifice restricts the flow rate of starting fluid into the engine to a safe rate.

* * * * *